US008529416B2

(12) United States Patent
Jennings

(10) Patent No.: US 8,529,416 B2
(45) Date of Patent: Sep. 10, 2013

(54) EXERCISING DEVICE

(75) Inventor: Michael Jennings, Cross Junction, VA (US)

(73) Assignee: TK Holding, Inc., Armada, MI (US)

( * ) Notice: Subject to any disclaimer, the term of this patent is extended or adjusted under 35 U.S.C. 154(b) by 543 days.

(21) Appl. No.: 12/712,633

(22) Filed: Feb. 25, 2010

(65) Prior Publication Data

US 2010/0216616 A1 Aug. 26, 2010

Related U.S. Application Data

(60) Provisional application No. 61/155,283, filed on Feb. 25, 2009.

(51) Int. Cl.
*A63B 21/015* (2006.01)
*A63B 22/14* (2006.01)
*A63B 22/16* (2006.01)

(52) U.S. Cl.
USPC ..... 482/115; 482/114; 482/146

(58) Field of Classification Search
USPC ..... 482/63–65, 79–80, 114–120, 139, 482/142, 145, 44–46, 51, 56–57, 60, 72, 482/92, 133–137, 146–147
See application file for complete search history.

(56) References Cited

U.S. PATENT DOCUMENTS

| | | | | | |
|---|---|---|---|---|---|
| 137,394 | A * | 4/1873 | Tice | 482/119 |
| 1,868,262 | A * | 7/1932 | Staley | 482/116 |
| 2,530,921 | A * | 11/1950 | Tougas | 482/119 |
| 3,007,280 | A * | 11/1961 | Berberich | 446/252 |
| 3,309,084 | A * | 3/1967 | Simmons | 482/62 |
| 3,758,107 | A * | 9/1973 | Potgieter | 482/63 |
| 3,953,026 | A * | 4/1976 | Stokely | 482/123 |
| 4,171,801 | A * | 10/1979 | Bell | 482/118 |
| 4,483,532 | A * | 11/1984 | Sparks | 482/79 |
| 4,542,898 | A * | 9/1985 | Grushkin | 482/71 |
| 4,600,189 | A * | 7/1986 | Olschansky et al. | 482/100 |
| 4,611,807 | A * | 9/1986 | Castillo | 482/119 |
| 4,749,182 | A * | 6/1988 | Duggan | 482/114 |
| 4,947,831 | A * | 8/1990 | Crabtree | 601/34 |
| 4,953,415 | A * | 9/1990 | Lehtonen | 74/141 |
| 5,039,091 | A * | 8/1991 | Johnson | 482/64 |
| 5,062,633 | A * | 11/1991 | Engel et al. | 482/118 |
| 5,125,882 | A * | 6/1992 | La Mothe et al. | 482/114 |
| 5,356,362 | A * | 10/1994 | Becker et al. | 482/142 |
| 6,405,585 | B1 * | 6/2002 | Hewitt | 73/116.05 |
| 6,413,192 | B2 | 7/2002 | Abelbeck | |
| 6,547,701 | B1 * | 4/2003 | Eschenbach | 482/57 |
| 7,794,365 | B2 * | 9/2010 | Daniel | 482/57 |
| 7,998,044 | B2 * | 8/2011 | Long | 482/141 |
| 2002/0107116 | A1 * | 8/2002 | Schulz | 482/97 |
| 2005/0096192 | A1 * | 5/2005 | Chen | 482/63 |
| 2009/0203508 | A1 * | 8/2009 | Hauser et al. | 482/139 |

* cited by examiner

*Primary Examiner* — Oren Ginsberg
(74) *Attorney, Agent, or Firm* — L.C. Begin & Associates, PLLC

(57) ABSTRACT

An exercising device includes a disc shaped member capable of rotating about a point of rotation. The exercising device also includes an elongated supporting member connected to the point of rotation of the disc shaped member. Further, the exercising device includes a braking mechanism carried by the elongated supporting member. The braking mechanism is capable of contacting the disc shaped member to apply a resistance to the rotation of the disc shaped member. Moreover, the exercising device includes a foot engaging member connected to the disc shaped member. The foot engaging member is adapted to be operated by feet of an individual. The operation of the foot engaging member by the individual against the resistance to the rotation applied by the braking mechanism exercises the individual.

11 Claims, 9 Drawing Sheets

EXERCISING DEVICE

CROSS REFERENCE TO RELATED APPLICATION

This application claims the benefit of U.S. Provisional Application No. 61/155,283 filed on Feb. 25, 2009 the disclosure of which is incorporated by reference.

FIELD OF THE DISCLOSURE

The present disclosure generally relates to exercising equipments, and, more particularly, to an exercising device for exercising leg, abdomen, hip and back muscles of an individual.

BACKGROUND OF THE DISCLOSURE

Exercising may refer to a combination of one or more physical activities performed by an individual with an intention of gaining, maintaining or improving physical fitness of body. Such physical activities may include swimming, running, rowing, cycling, walking and the like. Certain physical activities are performed using various exercising equipments. Conventional exercising equipments are generally designed to simulate a specific physical activity to be performed repetitively, and, therefore these exercising equipments affect specific portions of the body only. Examples of the conventional exercising equipments may include, but are not limited to, treadmills, elliptical trainers, stationary bicycles and the like.

Generally, the conventional exercising equipments include a complex arrangement of parts, and, therefore the conventional exercising equipments are cumbersome and bulky. Accordingly, such conventional exercising equipments are generally found only in gymnasiums, and having such conventional exercising equipments at home may be both difficult and inconvenient for the individuals. Further, since such conventional exercising equipments are designed for a specific physical activity to be performed repetitively; only a specific portion of the body gets affected. Accordingly, other parts of the body adjacent to the specific portions of the body remain unaffected. Furthermore, the conventional exercising equipments require the individuals to apply a constant amount of effort for performing the specific physical activity, and, therefore the individuals are devoid of an option of varying the amount of effort for performing the specific physical activity on the conventional exercising equipments.

SUMMARY OF THE DISCLOSURE

An exercising device includes a disc shaped member capable of rotating about a point of rotation. The disc shaped member may include a first surface, a second surface opposite to the first surface, and a peripheral surface. Further, the exercising device includes an elongated supporting member facing the second surface of the disc shaped member. The elongated supporting member may be connected to the point of rotation of the disc shaped member. Furthermore, the exercising device includes a braking mechanism carried by the elongated supporting member. The braking mechanism may be capable of contacting the disc shaped member to apply a resistance to the rotation of the disc shaped member. Moreover, the exercising device includes a foot engaging member connected to the first surface of the disc shaped member. The foot engaging member may be adapted to be operated by feet of an individual for rotating the disc shaped member about the point of rotation. The operation of the foot engaging member by the individual against the resistance to the rotation applied by the braking mechanism exercises the individual.

One embodiment of the exercising device may include a disc shaped member capable of rotating about a point of rotation. The disc shaped member may include a first surface, and a second surface opposite to the first surface. Further the exercising device includes an elongated supporting member facing the second surface of the disc shaped member. The elongated supporting member may include a first support member having an attachment portion connected to the point of rotation of the disc shaped member. Further, the elongated supporting member may include a second support member telescopically received in the first support member. Furthermore, the elongated supporting member may be adapted to be detachably associated with a pair of spaced apart members. The exercising device also includes a braking mechanism carried by a portion of the elongated supporting member. The portion of the elongated supporting member proximal to the attachment portion of the first support member. The braking mechanism is capable of contacting the second surface of the disc shaped member to apply a resistance to the rotation of the disc shaped member. Moreover, the exercising device includes a foot engaging member extending from the first surface of the disc shaped member. The foot engaging member is adapted to be operated by feet of a user, wherein the operation of the foot engaging member rotates the disc shaped member about the point of rotation. The operation of the foot engaging member against the resistance to the rotation applied by the braking mechanism exercises the individual.

Another embodiment of an exercising device may include a disc shaped member capable of rotating about a point of rotation. The disc shaped member may include a first surface, a second surface opposite to the first surface, and a peripheral surface. Further, the exercising device includes an elongated supporting member facing the second surface of the disc shaped member. The elongated supporting member may include a first support member, and a second support member telescopically receiving the first support member. A central portion of the first support member may be attached to the point of rotation of the disc shaped member for connecting the elongated supporting member to the disc shaped member. Furthermore, the exercising device includes a braking mechanism carried by a first end portion of the elongated supporting member. The braking mechanism capable of contacting the peripheral surface of the disc shaped member to apply a resistance to the rotation of the disc shaped member. In addition, the exercising device includes a foot engaging member attached to the point of rotation of the disc shaped member. The foot engaging member adapted to be operated by feet of an individual, the operation of the foot engaging member rotating the disc shaped member about the point of rotation. The operation of the foot engaging member by the individual against the resistance to the rotation applied by the braking mechanism exercises the individual.

BRIEF DESCRIPTION OF THE DRAWINGS

These and other features and advantages of the present disclosure will be apparent from the following detailed description of preferred embodiments and best mode, appended claims, and accompanying drawings in which:

Like reference numerals refer to like parts throughout the description of several views of the drawings.

DETAILED DESCRIPTION OF THE DISCLOSURE

Figure 1:
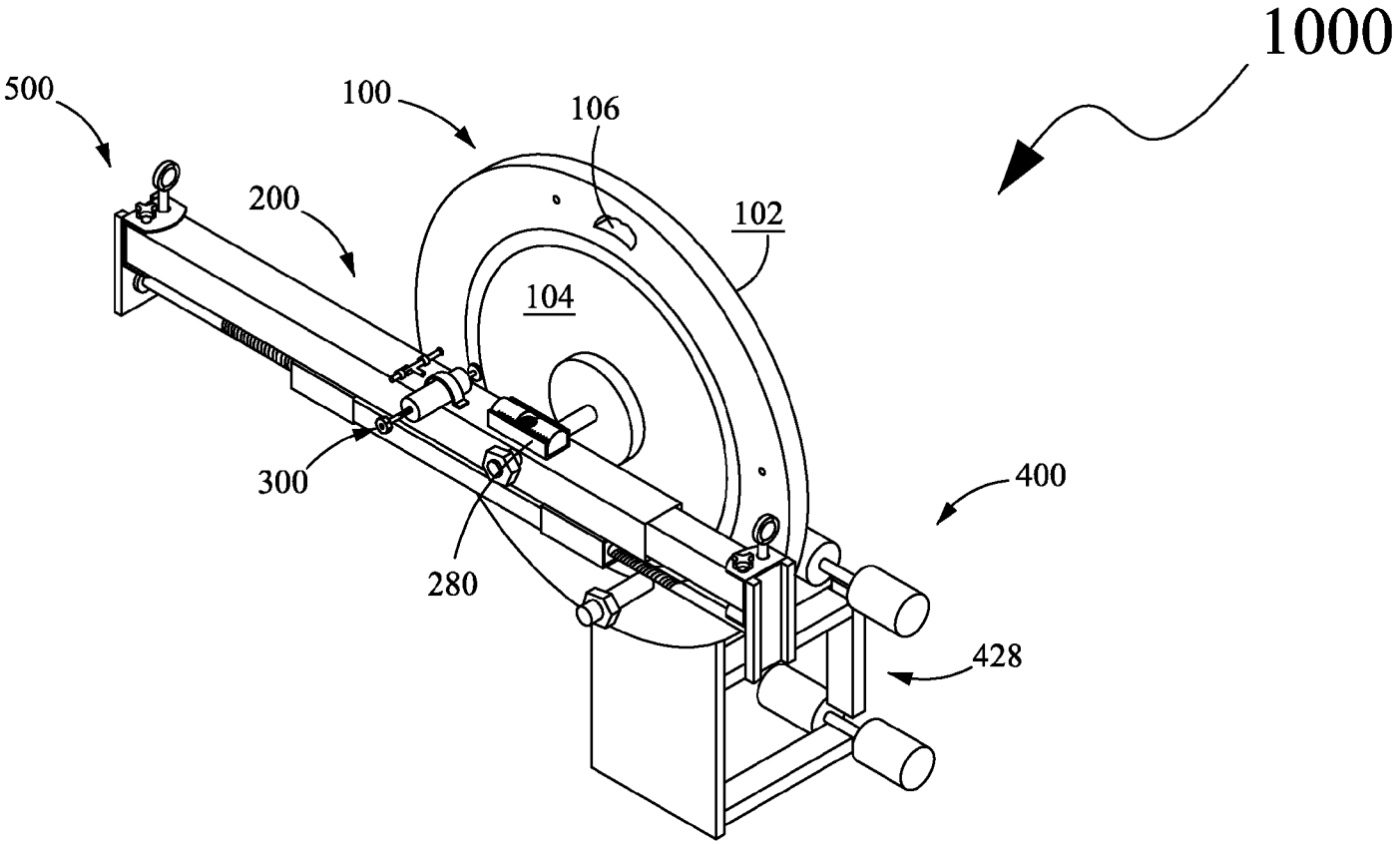
FIG. 1 is a perspective view of one embodiment of an exercising device.

The exemplary embodiments described herein in detail for illustrative purposes are subject to many variations in structure and design. It should be emphasized, however, that the present disclosure is not limited to a particular exercising device, as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The use of terms "including," "comprising," or "having" and variations thereof herein is meant to encompass the items listed thereafter and equivalents thereof as well as additional items. The terms such as "first," "second," "outer," "inner," "free, "distal," "proximate," and other variations thereof as used herein, do not denote an order, elevation or importance, but rather used signify the presence of at least one of the referenced item. Further, the terms, "a" and "an" herein do not denote a limitation of quantity, but rather denote the presence of at least one of the referenced item.

Disclosed is an exercising device which may be used for exercising muscles, such as legs, abdomen, hip, back, and other lower muscles of an individual. The exercising device includes a disc shaped member capable of rotating about a point of rotation. The disc shaped member may include a first surface, a second surface opposite to the first surface. Further, the exercising device includes an elongated supporting member facing the second surface of the disc shaped member. The elongated supporting member may be connected to the point of rotation of the disc shaped member. Furthermore, the exercising device includes a braking mechanism carried by the elongated supporting member. The braking mechanism may be capable of contacting the disc shaped member to apply a resistance to the rotation of the disc shaped member. Moreover, the exercising device includes a foot engaging member connected to the first surface of the disc shaped member. The foot engaging member may be adapted to be operated by feet of an individual for rotating the disc shaped member about the point of rotation. The operation of the foot engaging member by the individual against the resistance to the rotation applied by the braking mechanism exercises the individual.

Referring to FIGS. 1-4, one embodiment of an exercising device 1000, is shown. The exercising device may be used for exercising muscles, such as legs, abdomen, hip, back, and other lower muscles of a user 2000 (hereinafter referred to as 'individual 2000'). The exercising device 1000 may include a disc shaped member 100 having a first surface 102 and a second surface 104 opposite to the first surface 102. Specifically, the disc shaped member 100 is capable of rotating about an axis of rotation A-A' (shown in FIG. 2). The disc shaped member 100 may include a handle slot 106. The handle slot 106 is adapted to facilitate gripping of the disc shaped member 100. The disc shaped member 100 further includes a hole 108 at the center of the disc shaped member 100 around which the disc shaped member 100 rotates. This hole 108 may be referred to as 'point of rotation 108' of the disc shaped member 100.

Furthermore, the disc shaped member 100 may include a bearing member 110 carried by the second surface 104. Specifically, the bearing member 110 conforms to the point of rotation 108. The disc shaped member 100 may further include a set of lock holes, such as lock holes 112, carried by the second surface 104.

The disc shaped member 100 may be composed of a lightweight metal, such as aluminum. Alternatively, the disc shaped member 100 may be composed of a plastic material. Furthermore, it should be clearly understood that the disc shape of the disc shaped member 100 should not be construed as a limitation to the present disclosure. Accordingly, the disc shaped member 100 may also be of any other shape, such as a square shape, or any other shape.

The exercising device 1000 may further include an elongated supporting member 200. The elongated supporting member 200 includes a first support member 202 and a second support member 204 substantially received (or telescopically received) within the first support member 202. Such receiving of the first support member 202 in the second support member 204 configures the elongated supporting member 200.

Specifically, the first support member 202 includes a first end portion 206 (also referred to as a free end portion 206), and a second end portion 208. Similarly, the second support member 204 includes a first end portion 210 (also referred to as a free end portion 210), and a second end portion 212. The second end portion 212 of the second support member 204 may be received substantially within the second end portion 208 of the first support member 202. Further, the first end portion 206 and the first end portion 210 include a hole 207 and a hole 209 respectively, and a hole 216 at an attachment portion 214 thereof.

The elongated supporting member 200 further includes a shaft 218 and a pair of locking nuts, such as a locking nut 220 and a locking nut 222. The shaft 218 may be removably received through the hole 216 and the point of rotation 108 for attaching the disc shaped member 100 to the elongated supporting member 200. Specifically, the pair of locking nuts 220, 222 may be threadably attached to the free end portions of the shaft 218 for locking the shaft 218. Additionally, flat washers may also be attached along with the locking nuts 220, 222 to the free end portions of the shaft 218. Further, such attaching using the shaft 218 may allow a free rotation of the disc shaped member 100 about its point of rotation 108. Specifically, the bearing member 110 supports the shaft 218 and facilitates the rotation of the disc shaped member 100 about its point of rotation 108. The free end portion 206 and the free end portion 210 may be adapted to detachably support the exercising device 1000 on a pair of vertical walls, or a vertical frame. The attachment of the free end portions 206, 210 of the elongated supporting member 200 on the pair of vertical walls or the vertical frame will be explained later in the description.

Figure 2:
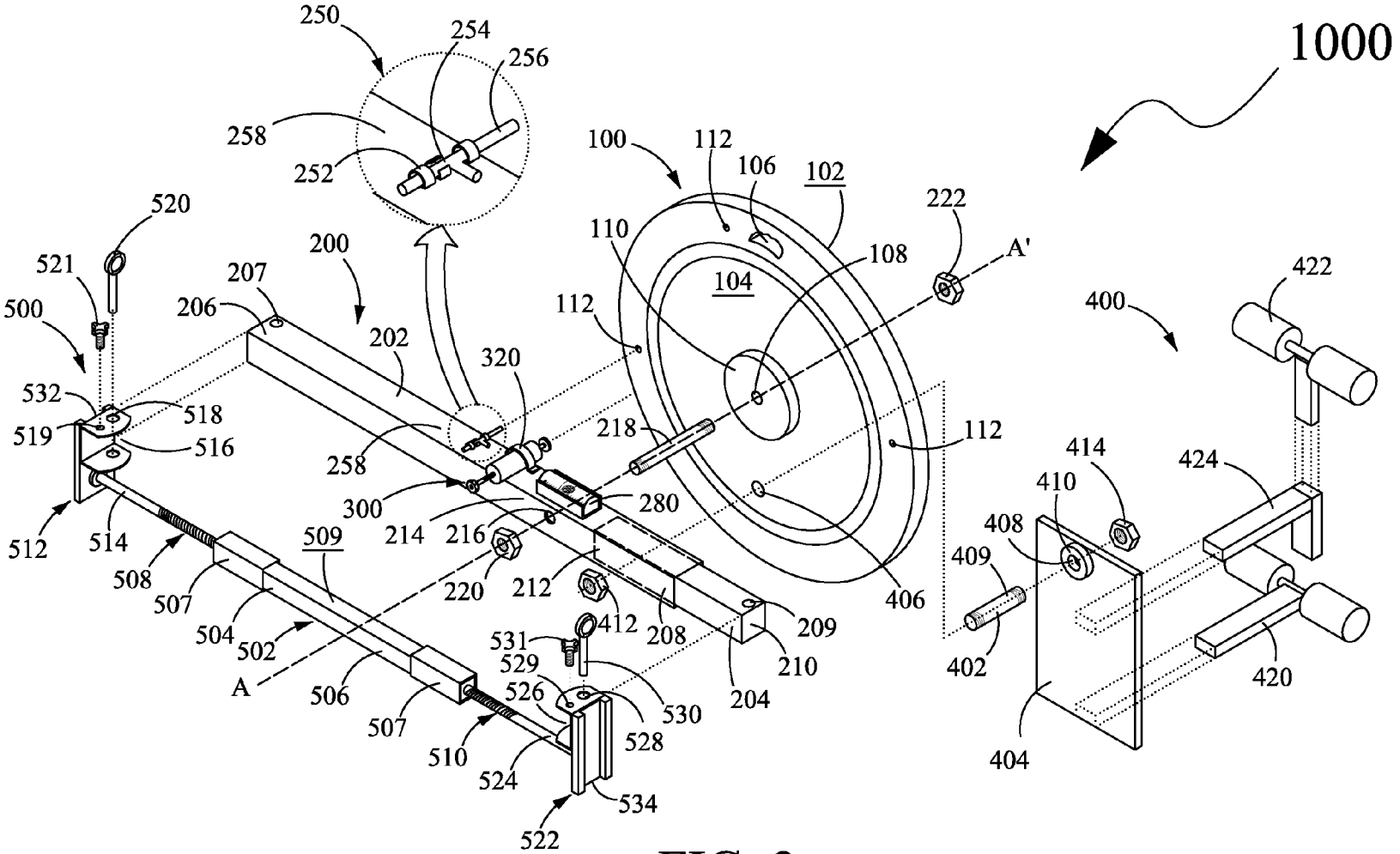
FIG. 2 is an exploded view of the exercising device of FIG. 1.

The elongated supporting member 200 may further include a latching mechanism 250 carried by the elongated supporting member 200 (shown in an enlarged view in FIG. 2). The latching mechanism 250 may include an attaching member 252 and a latch member 254 housed within the attaching member 252. The attaching member 252 may be attached to a surface of the elongated supporting member 200. More specifically, the latching mechanism 250 may be attached to a surface of an intermediate portion 258 of the first support member 202. The latch member 254 may be operated for moving a free end portion 256 of the latch member 254 to engage with a hole, such as the lock hole 112 on the disc shaped member 100. Such engagement of the free end portion 256 of the latch member 254 precludes the rotation of the disc shaped member 100, preferably, in a non-operational state of the exercising device 1000.

Further, the elongated supporting member 200 may include at least one level indicator, such as a level indicator 280, disposed on the attachment portion 214 of the elongated supporting member 200. The level indicator 280 may be adapted to indicate an alignment of the elongated supporting member 200 with respect to ground surface 600 (shown in FIG. 4). The level indicator 280 may be a spirit level. However, other conventional level indicators may also be used.

Figure 3:
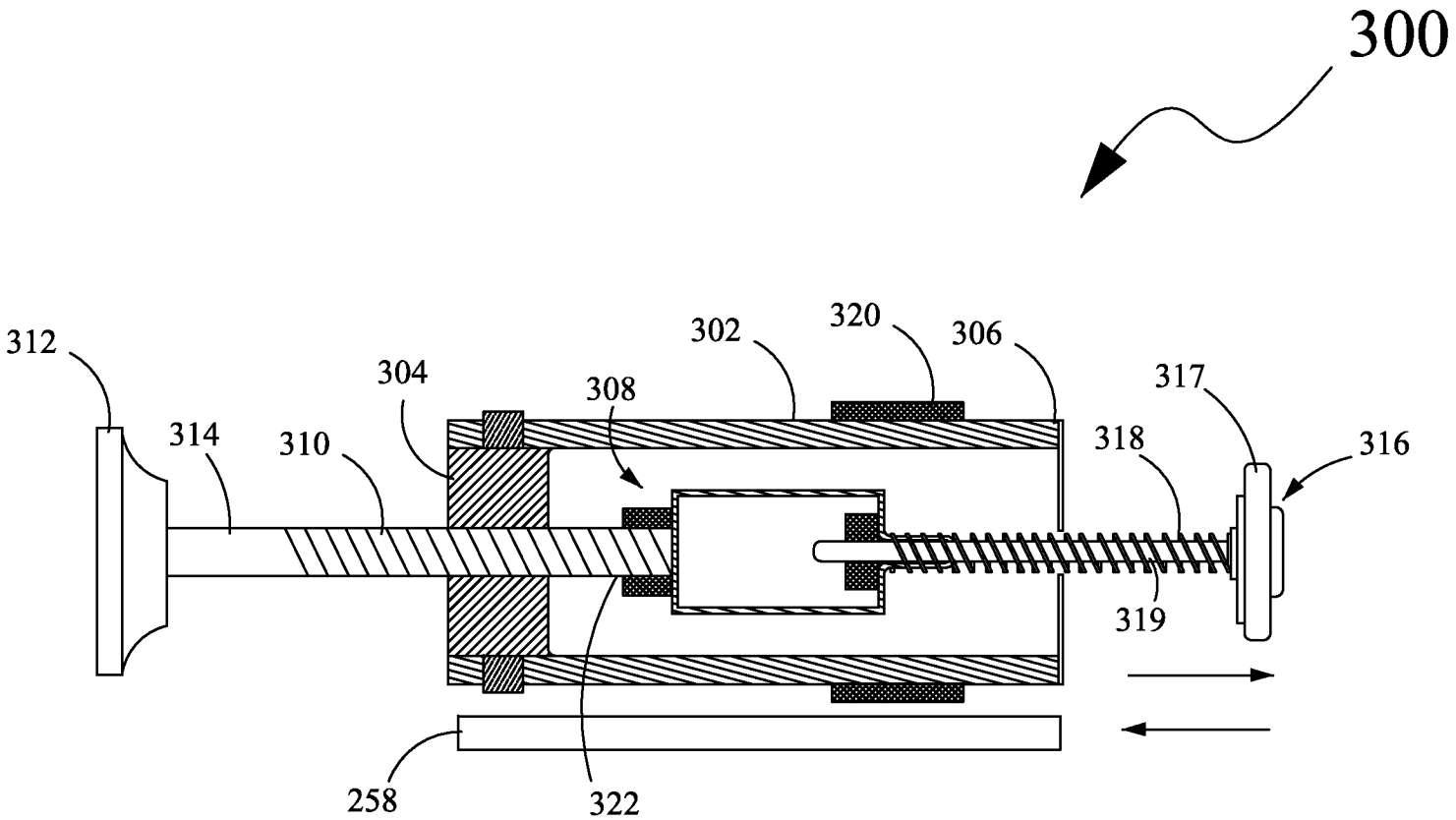
FIG. 3 is a sectional view of a braking mechanism of the exercising device of FIG. 1.

As best shown in FIG. 3, the exercising device 1000 may further include a braking mechanism 300. The braking mechanism 300 may be carried by the intermediate portion 258 of the elongated supporting member 200. As shown, this intermediate portion 258 may be proximal to the attachment portion 214 of the elongated supporting member 200. Herein it may be noted that the braking mechanism 300 may be positioned at a position other than that depicted in the figures without departing from the spirit of the disclosure. However, the position should be such that the braking mechanism 300 when operated may be able to contact the second surface 104 of the disc shaped member 100.

The braking mechanism 300 is capable of contacting the second surface 104 of the disc shaped member 100 to apply a resistance to the rotation of the disc shaped member 100. Specifically, the braking mechanism 300 includes a hollow elongated housing 302 having a first end portion 304 and a second end portion 306. The first end portion 304 may include a socket head set screw and a nut. The braking mechanism 300 further includes an actuation member 308 having a threaded shaft 310. The threaded shaft 310 may be substantially received within the hollow elongated housing 302. Specifically, the threaded shaft 310 may be substantially received within the hollow elongated housing 302 from the first end portion 304.

The braking mechanism 300 furthermore may include a knob 312 associated with a first end portion 314 of the threaded shaft 310. The knob 312 may be capable of being rotated for rotating the threaded shaft 310. More specifically, the knob 312 may be rotated by the individual 2000 for rotating the threaded shaft 310. Further, the actuation member 308 may also include a tab member 316 having a tab 317 and a spring 318 associated with the tab 317. Specifically, a nut and a spacer may attach the spring 318 with the tab 317. The spring 318 may be spirally wound over a rod 319 which may be associated to the tab 317. The spring 318 may provide a dampening effect when the knob 312 is operated, making the tab 317 contact the second surface 104 of the disc shaped member 100.

The spring 318 may be associated with the threaded shaft 310. Specifically, the rod 319 may be associated with a second end portion 322 of the threaded shaft 310 by means of an elongated spacer, and a pair of hex nuts. Additionally, a set of spacers may also be used along with the hex nuts.

The association of the spring 318 with the threaded shaft 310 may allow a forward and backward (or to and fro) movement of the tab 317, when the threaded shaft 310 may be rotated. The forward movement of the tab 317 extends the tab 310 for contacting the second surface 104 of the disc shaped member 100. The contacting of the tab 317 applies resistance to the rotation of the disc shaped member 100. Similarly, the rotation of the threaded shaft 310 in an opposite direction causes the tab 317 to move backwards, or away from the second surface 104, of the disc shaped member 100. Such movement of the tab 317 backwards, or away from the tab 317, reduces or eliminates resistance to the rotation of the disc shaped member 100.

The tab 317 may further include a brake pad (not shown) disposed on a free surface thereof. The brake pad may ensure a uniform application of resistance to the disc shaped member 100. The braking mechanism 300 may also have a clamping member 320 (refer FIGS. 2 and 3) adapted to engage with an outer surface of the hollow elongated housing 302 and to the elongated supporting member 200 for attaching the braking mechanism 300 to the elongated supporting member 200.

Furthermore, the exercising device 1000 may also include a foot engaging member 400. The foot engaging member 400 may extend from the first surface 102 of the disc shaped member 100. The foot engaging member 400 may be adapted to be operated by feet of the individual 2000. The operation of the foot engaging member 400 rotates the disc shaped member 100 about the point of rotation 108. The structural configuration of the foot engaging member 400 will now be described in detail.

The foot engaging member 400 includes a shaft 402 attached to the first surface 102 of the disc shaped member 100. The foot engaging member 400 further includes a support plate 404 attached to a free end portion 409 of the shaft 402. Specifically, the shaft 402 may be received within a hole, such as a hole 406, on the disc shaped member 100, and a hole 408 on a bearing member 410 of the support plate 404. Such receiving of the shaft 402 in the hole 406 and in the bearing member 410 adjustably attaches the foot engaging member 400 to the disc shaped member 100. However, the individual 2000 may adjust position of the foot engaging member 400 according to his/her desire. Further, such attachment of the foot engaging member 400 to the disc shaped member 100 facilitates operation of the foot engaging member 400. Additionally, a pair of locking nuts, such as locking nuts 412, 414, along with a pair of washers and spacers may be attached to free end portions of the shaft 402 for securing the shaft 402 to the disc shaped member 100 and the support plate 404 respectively.

As best shown in FIG. 2, the foot engaging member 400 further includes one or more padded support members, such as a padded support member 420 and a padded support member 422. The foot engaging member 400 may further include an intermediate support member 424 adapted to be attached with the padded support member 422. Specifically, the intermediate support member 424 may be attached with the padded support member 422 by a dog leg snap button. Each of the padded support member 420 and intermediate support member 424 may be attached to support plate 404. Specifically, the padded support member 420 and intermediate support member 424 may be welded to support plate 404. Further, the padded support member 420 and padded support member 422 may configure a space 428 capable of receiving the feet of the individual 2000 for operating the foot engaging member 400. At least one of the padded support member 420 and padded support member 422 may include foam materials for providing the padding. Such padding may be necessary for cushioning the feet of the individual 2000.

The exercising device 1000 may further include an extendable mounting member 500 adapted to detachably associate the elongated supporting member 200 to a pair of spaced apart members 550, 560. The extendable mounting member 500 may facilitate the supporting of the exercising device 1000.

The extendable mounting member 500 may include a body member 502 having a first end portion 504 and a second end portion 506 opposite to the first end portion 504. A pair of cushioning covers 507 may be disposed on an outer surface 509 of the body member 502.

The extendable mounting member 500 may further include a first threaded member 508 and a second threaded member 510. The first threaded member 508 may be threadably attached (or telescopically attached) to the first end portion 504 of the body member 502. The first threaded member 508 may include a slotted member 512 at a free end 514 thereof. Alternatively, the first threaded member 508 may include a nut (not shown) attached to the slotted member 512 at the free end 514 of the first threaded member 508.

The slotted member 512 may include a slot 516. Further, the slotted member 512 may include a pair of holes 518. The slotted member 512 may be adapted to receive the first end portion 206 of the elongated supporting member 200. Specifically, the first end portion 206 of the elongated supporting member 200 may be received in the slot 516 such that the pair of holes 518 may be aligned with the hole 207. A locking key 520 may be inserted in through the pair of holes 518 and the hole 207 to preclude relative movement of the elongated supporting member 200 and the slotted member 512. Additionally, the slotted member 512 may include an auxiliary hole 519 adapted to receive an auxiliary knob 521. The auxiliary knob 521 may be capable of being rotated for further securing the first end portion 206 of the elongated supporting member 200 to the extendable mounting member 500.

Similarly, the second threaded member 510 may be threadably attached (or telescopically attached) to the second end portion 506 of the body member 502. The second threaded member 510 may include a slotted member 522 at a free end portion 524 thereof. Alternatively, the second threaded member 510 may include a nut (not shown) attached to the slotted member 522 at the free end portion 524 of the second threaded member 510. The slotted member 522 may include a slot 526. Further, the slotted member 522 may include a pair of holes 528 (only one hole 528 depicted in FIG. 2). The slotted member 522 may be adapted to receive the first end portion 210 of the elongated supporting member 200. Specifically, the first end portion 210 of the second support member 204 of the elongated supporting member 200 may be received in the slot 526 such that the pair of holes 528 may be aligned with the hole 209. A locking key 530 may be inserted through the aligned pair of holes 528 and the hole 209 to preclude relative movement of the elongated supporting member 200 and the slotted member 522. Additionally, the slotted member 522 may include an auxiliary hole 529 adapted to receive an auxiliary knob 531. The auxiliary knob 531 may be capable of being received for further securing the first end portion 210 of the elongated supporting member 200 to the extendable mounting member 500. The receiving of the first end portion 206 and the first end portion 210 of the elongated supporting member 200 detachably associates, or mounts the elongated supporting member 200 on the extendable mounting member 500.

Figure 4:
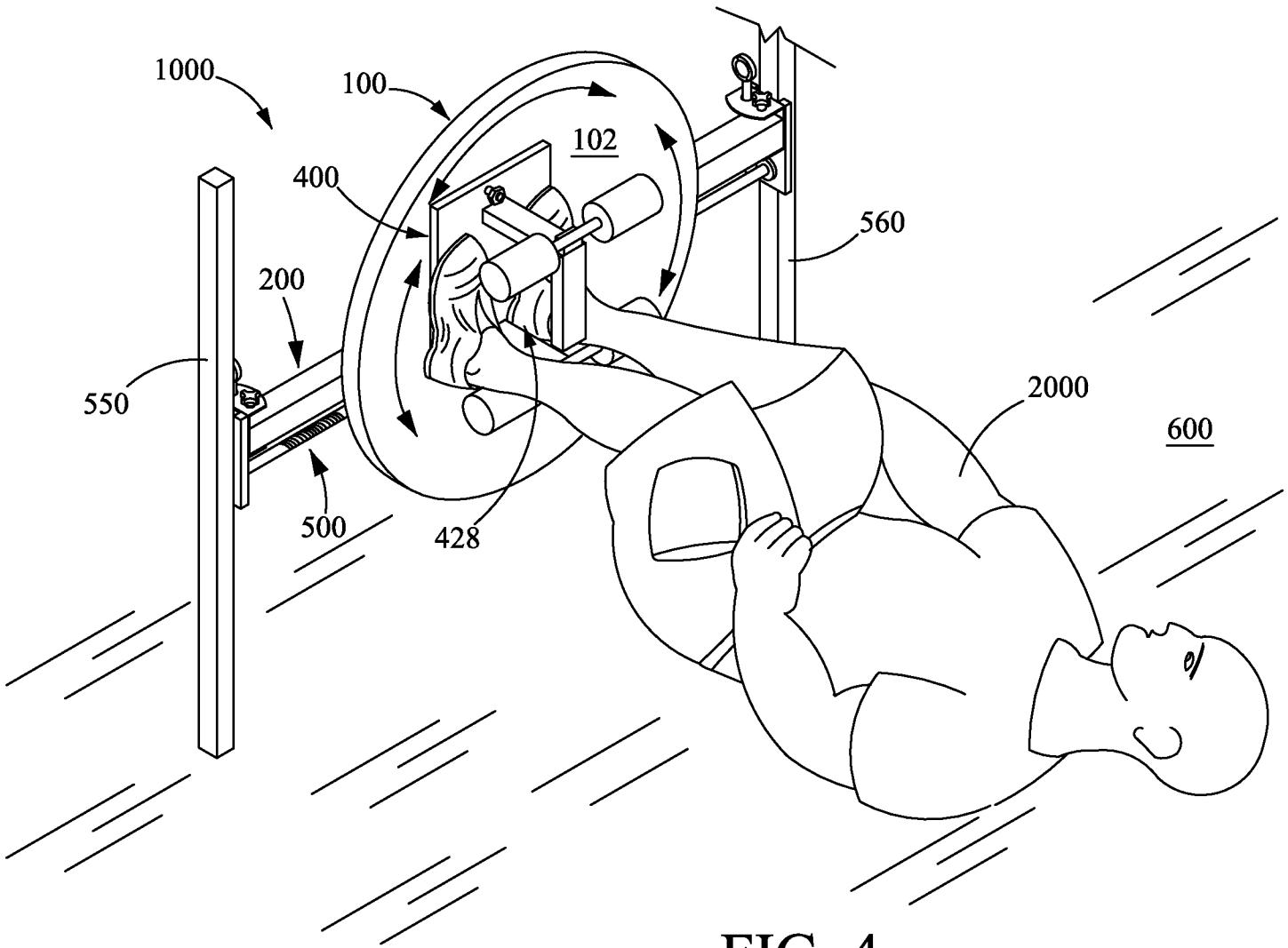
FIG. 4 is a perspective view of the exercising device of FIG. 1 in use.
Figure 5:
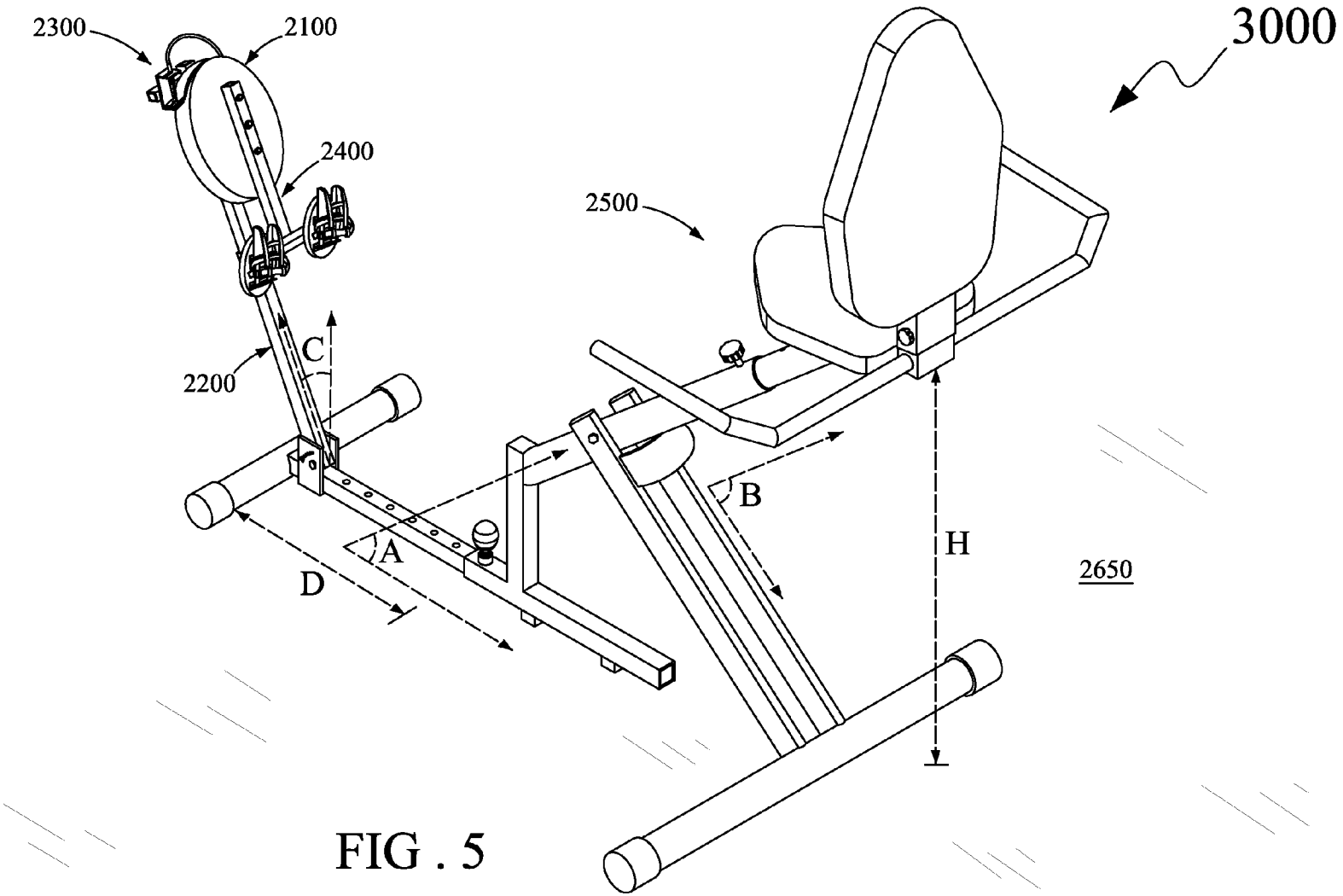
FIG. 5 is a perspective view of second embodiment of the exercising device.

Further, each of the slotted member 512 and the slotted member 522 include an elongated channel, such as an elongated channel 532 and an elongated channel 534 respectively. Each of the elongated channel 532 and the elongated channel 534 may include an adhesive backed polyurethane strip (not shown). The elongated channel 532 and the elongated channel 534 are configured to be detachably attached with the pair of spaced apart members, such as members 550 and 560 respectively (as shown in FIG. 4). An example of a suitable pair of spaced apart members 550, 560 may be a door frame.

Specifically, the rotation of the body member 502 extends each of the first threaded member 508 and the second threaded member 510 out of the body member 502, thereby snugly attaching the slotted member 512 and the slotted member 522 to the pair of spaced apart members 550 and 560. Such attachment of the slotted member 512 and the slotted member 522 to the pair of spaced apart members 550 and 560 enables the exercising device 1000 to be supported on the pair of spaced apart members 550, 560. The provided polyurethane strip may help in further securing the exercising device 1000 on the pair of spaced apart members 550, 560.

During utilization of the disclosed exercising device 1000, slotted members such as the slotted member 512 and the slotted member 522 are aligned to a pair of spaced apart members 550 and 560 respectively (such as a door frame). Thereafter, the body member 502 may be rotated to extend each of the first threaded member 508 and the second threaded member 510 out of the body member 502 for snugly attaching the slotted member 512 and the slotted member 522 of the first threaded member 508 and the second threaded member 510 to the spaced apart members 550, 560. The association of the elongated supporting member 200 to a pair of spaced apart members 550, 560 provides support to the entire exercising device 1000.

Further, during the utilization, the first end portion 206 of the elongated supporting member 200 may be locked in the slot 516 and the second end portion 208 of the elongated supporting member 200 may be locked in the slot 526. Thereafter for exercising, the individual 2000 may lie on the ground surface 600 placing his back portion on the ground surface 600. The individual 2000 may thereafter engage feet thereof with the foot engaging member 400 by positioning the feet in the space 428 configured between the padded support member 420 and the padded support member 422. Thereafter, the individual 2000 may move the feet by applying pressure on the foot engaging member 400, thereby rotating the disc shaped member 100 about the point of rotation 108 in at least one of an anticlockwise and a clockwise direction. Such rotation of the disc shaped member 100 exercises the individual 2000. Further the individual 2000 may operate the braking mechanism 300 for applying or removing a resistance to the rotation of the disc shaped member 100. The exercising device 1000 may be uninstalled upon use thereof, for placing the exercising device 1000 in any convenient location.

Referring to FIGS. 5-9, another embodiment of an exercising device 3000 which may be used for exercising muscles, such as legs, abdomen, hip, back, and other lower muscles of a user 4000 (hereinafter referred to as 'individual 4000').

The exercising device 3000 may include a disc shaped member 2100 having a first surface 2102, a second surface 2104 opposite to the first surface 2102, and a peripheral surface 2106. Specifically, the disc shaped member 2100 is capable of rotating about an axis of rotation X-X' (shown in FIG. 6). Further, the disc shaped member 2100 includes a plurality of holes 2101, 2105, 2108. The hole 2108 may be present at the center of the disc shaped member 2100 around which the disc shaped member 2100 may rotate. This hole 2108 may be referred to as 'point of rotation 2108' of the disc shaped member 2100. Additionally, the disc shaped member 2100 may include a bearing member 2110 carried by the second surface 2104. Specifically, the bearing member 2110 conforms to the point of rotation 2108.

Similar to the disc shaped member 100, the disc shaped member 2100 may be composed of a lightweight metal, such as aluminum. Alternatively, the disc shaped member 2100 may be composed of a plastic material. Furthermore, it should be clearly understood that the disc shape of the disc shaped member 2100 should not be construed as a limitation to the present disclosure. Accordingly, the disc shaped member 2100 may also be of any other shape, such as a square shape, or any other shape.

The exercising device 3000 may further include an elongated supporting member 2200 facing the second surface 2104 of the disc shaped member 2100. The elongated supporting member 2200 includes a first support member 2202 and a second support member 2204 telescopically received within the first support member 2202. Such receiving of the first support member 2202 in the second support member 2204 configures the elongated supporting member 2200.

Specifically, the first support member 2202 includes a first end portion 2206 (also referred to as a free end portion 2206, or a first end portion 2206 of the elongated supporting member 2200), and a second end portion 2208. Similarly, the second support member 2204 includes a first end portion 2210 (also referred to as a second end portion 2210 of the elongated supporting member 2200), and a second end portion 2212. The second end portion 2208 of the first support member 2202 is telescopically received within the second end portion 2212 of the second support member 2204.

Even more specifically, the first support member 2202 includes a plurality of adjustment holes 2214 proximal to the second end portion 2208, and a securing hole 2215 at a central portion 2213. Further, the second support member 2204 includes an adjustment hole 2216 proximal to the second end portion 2212. A hole of the plurality of adjustment holes 2214 may be aligned with the adjustment hole 2216, and a knob 2224 may be used to secure the telescopically received first support member 2202 in the second support member 2204. The knob 2224 used may include a rotating bulb 2226, and a threaded rod 2228 integral to and extending from the rotating bulb 2226. The rotating bulb 2208 may be rotated to insert the threaded rod 2228 in the adjustment hole 2216. The insertion of the threaded rod 2219 may clamp the first support member 2202 with the second support member 2204.

Further, similar to the disc shaped member 2100, the elongated supporting member 2200 may also be made of a lightweight metal, such as aluminum. Alternatively, the elongated supporting member 2200 may also be composed of a plastic material.

Figure 6:
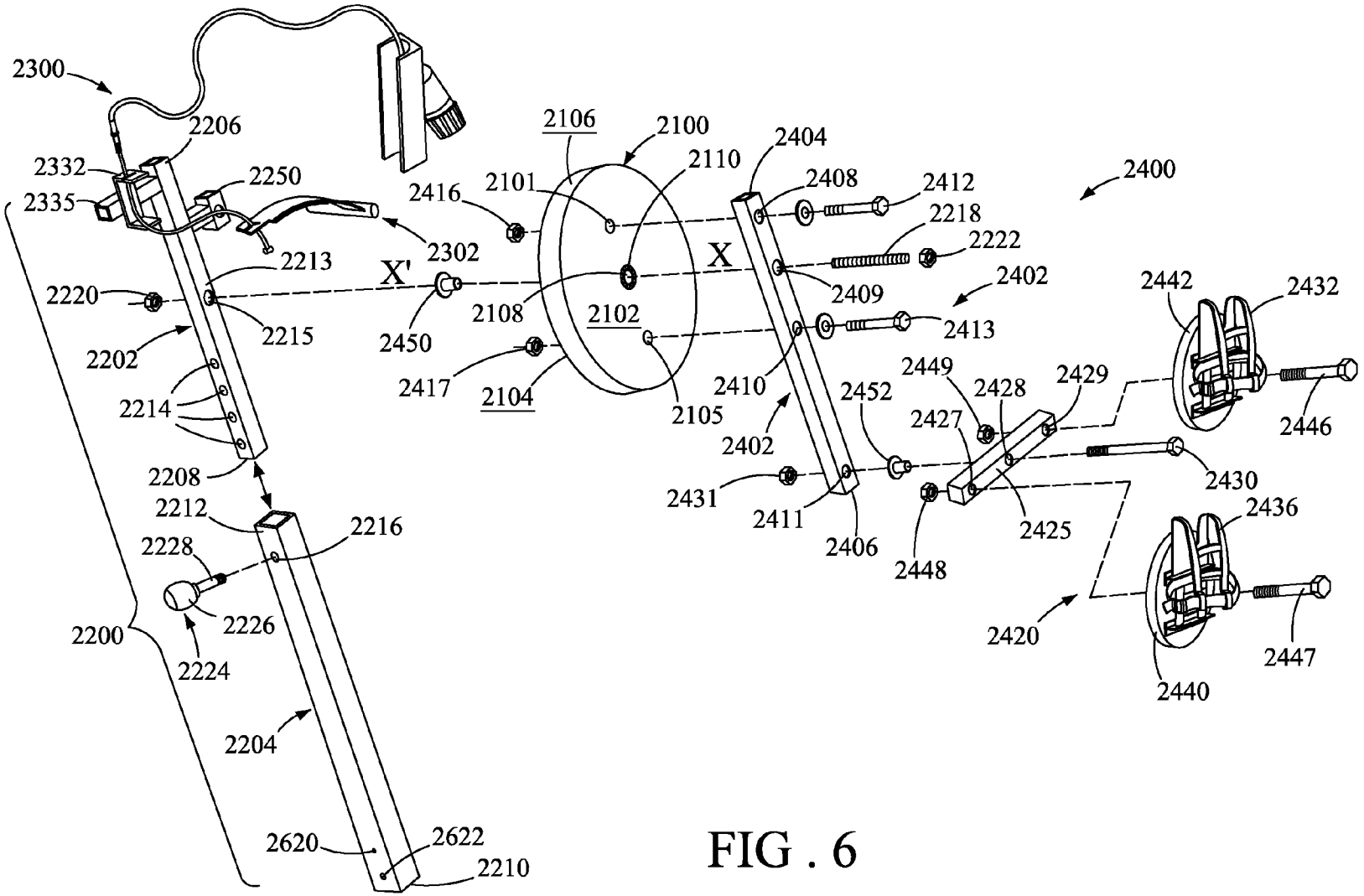
FIGS. 6-8 is an exploded view of the exercising device of FIG. 5.

As best shown in FIG. 6, the exercising device 1000 may further include a braking mechanism 2300. The braking mechanism 2300 may be carried by the first end portion 2206 of the elongated supporting member 2200. Herein it may be noted that the braking mechanism 2300 may be positioned at a position other than that depicted in the figures without departing from the spirit of the disclosure. However, the position should be such that the braking mechanism 2300 when operated may be able to contact the peripheral surface 2106 of the disc shaped member 2100.

The braking mechanism 2300 is capable of contacting the peripheral surface 2106 of the disc shaped member 2100 to apply a resistance to the rotation of the disc shaped member 2100. Specifically, the braking mechanism 2300 includes a curved brake plate 2302 adapted to contact with the peripheral surface 2106 of the disc shaped member 2100 for applying the resistance to the rotation of the disc shaped member 2100. In the FIG. 6, the curved brake plate 2302 is shown to be in a non-operational state, i.e., not in contact with the disc shaped member 2100.

Figure 7:
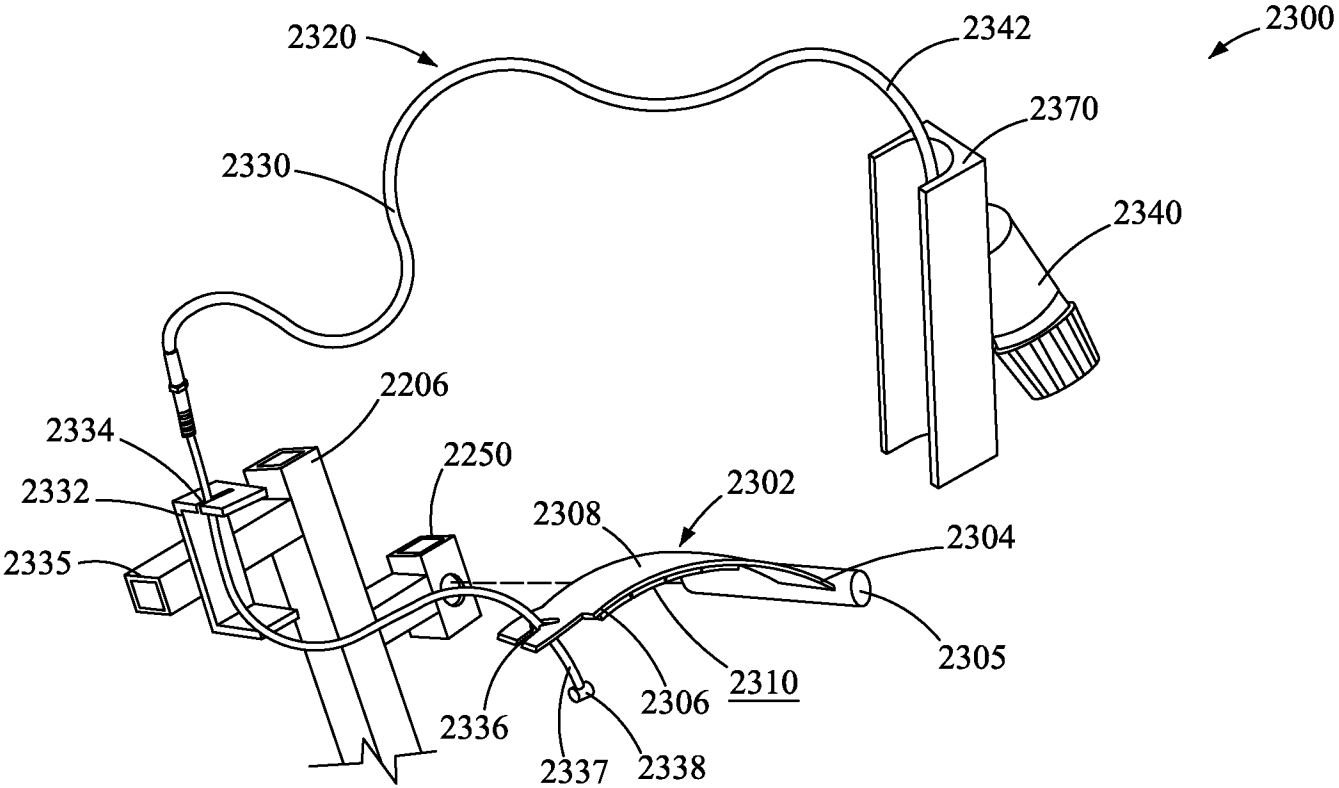

Referring to FIG. 7, the curved brake plate 2302 includes a first end portion 2304 fixed at the first end portion 2206 of the elongated supporting member 2200. Specifically, the first end portion 2206 may include a bracket 2250 which carries the curved brake plate 2302. Even more specifically, the first end portion 2304 of the curved brake plate 2302 includes a supporting piece 2305 fixed to the first end portion 2206 of the elongated supporting member 2200. In one embodiment, the supporting piece 2305 may be welded to the bracket 2250.

Further, the curved brake plate 2302 includes a second end portion 2306 opposite to the first end portion 2304, and an operating section 2308 having a surface 2310 substantially parallel to the peripheral surface 2106 of the disc shaped member 2100, such that, the surface 2310 conforms to the peripheral surface 2106 when the operating section 2308 is contacted with the peripheral surface 2106 of the disc shaped member 2100.

Further, the braking mechanism 2300 includes a controlling mechanism 2320 operatively associated to the curved brake plate 2302. The controlling mechanism 2320 is adapted to control extent of contact between the peripheral surface 2106 and the operating section 2308 of the curved brake plate 2302. It will be apparent to a person skilled in the art that such control of the extent of contact varies resistance to the rotation of the disc shaped member 2100.

As best shown in FIG. 7, the controlling mechanism 2300 includes a tension wire 2330 operatively coupled to the second end portion 2306 of the curved brake plate 2302. The tension wire 2330 may be supported by a bracket 2332 attached to the first end portion 2206 of the first support member 2200. Specifically, the bracket 2332 includes a cut section 2334 receiving the tension wire 2330. The bracket 2332 as shown may be supported on a piece 2335 attached to the first end portion 2206 of the first support member 2200.

The second end portion 2306 of the curved brake plate 2302 may also include a cut section 2336 receiving the tension wire 2330. Further, an end portion 2337 of the tension wire 2330 may include a retainer 2338 for fixing the tension wire 2330 in the cut section 2336.

Further, the controlling mechanism 2300 includes a knob 2340 associated with a free end 2342 of the tension wire 2330. The knob 2340 is capable of rotating for operating the tension wire 2330. The operation of the tension wire 2330 moves the curved brake plate 2302 up and down.

Specifically, the knob 2340 includes a core (not shown). The tension wire 2330 may be wound over the core. The rotation of the knob 2340 leads to rotation of the core. The rotation of the core unwinds the tension wire 2330 from the core, thereby releasing tension therein. The release of tension may in turn move the second end portion 2306 of the curved brake plate 2302 downwards (due to inherent inertia/tension in the curved brake plate 2302). Such movement of the second end portion 2306 may bring the curved brake plate 2302 in contact with the peripheral surface 2106 of the disc shaped member 2100. The contact of the curved brake plate 2302 (and more particularly the surface 2310) with the peripheral surface 2106 may apply the resistance to the rotation of the disc shaped member 2100.

Additionally, the braking mechanism 300 may include a pad 2370. The pad 2370 may have the knob 2340 secured thereto. This pad 2370 may be adapted to secure to different parts of the exercising device 3000. For example, the pad 2370 may be adapted to secure to the elongated supporting member 2100. Such securing may make the pad 2370 easily available to the individual 4000.

Furthermore, the exercising device 3000 includes a foot engaging member 2400 removably attached to the disc shaped member 2100. The foot engaging member 2400 may be adapted to be operated by feet of the individual 4000. The operation of the foot engaging member 2400 rotates the disc shaped member 2100 about the point of rotation 2108. The structural configuration of the foot engaging member 2400 will now be described in detail.

As shown in FIG. 6, the foot engaging member 2400 includes a lever arm 2402. The lever arm 2402 includes a first end portion 2404, and a second end portion 2406 opposite to the first end portion 2404. The first end portion 2404 of the lever arm 2402 is attached to the disc shaped member 2010.

Specifically, the lever arm 2402 includes a plurality of fitting holes 2408, 2409, 2410, 2411. To attach the lever arm 2402 to the disc shaped member 2100, the fitting hole 2409 is aligned to the point of rotation 2108. Further, a shaft 2218 may be removably received in the securing hole 2215 provided on the elongated supporting member 2200, the point of rotation 2108, and the fitting hole 2409. In addition a spacer 2450 may be fitted over the shaft 2218. The spacer 2450 may maintain a space between the disc shaped member 2100 and the elongated supporting member 2200, thereby precluding any contact there-between. Thereafter, a pair of locking nuts, such as locking nuts 2220, 2222 may be threadably attached to end portions of the shaft 2218 for securing the lever arm 2402, the disc shaped member 2100 and the elongated supporting member 2200. Additionally, flat washers may also be attached along with the locking nuts 2220, 2222 to the end portions of the shaft 2218. It should be understood that such attaching using the shaft 2218 may allow a free rotation of the disc shaped member 2100 about its point of rotation 2108. Specifically, the bearing member 2110 may support the shaft 2218 and facilitate the rotation of the disc shaped member 2100 about its point of rotation 2108. Additionally, the fitting holes 2408, 2410 may be aligned with holes 2101, 2105 and bolts 2412, 2413, respectively, may be received through the aligned holes for additionally securing the lever arm 2402 to the disc shaped member 2100. The bolts 2412, 2413 may be secured using locking nuts 2416, 2417, respectively.

Further, the foot engaging member 2400 includes a pedal section 2420 carried by the second end portion 2406 of the level arm 2402. Specifically, the pedal section 2420 includes a retainer plate 2425 attached to the second end portion 2406. More specifically, the retainer plate 2425 includes a plurality of holes 2427, 2428, 2429. For attaching the retainer plate 2425, the hole 2428 is aligned to the fitting hole 2411 of the lever arm 2402, and a bolt 2430 may be received through the hole 2428 and the fitting hole 2411. The bolt may be then secured using a locking nut 2431. In addition a spacer 2452 may be fitted over the bolt 2430. The spacer 2452 may maintain a space between the lever arm 2402 and the retaining plate 2425, thereby precluding any contact therebetween.

Further, the pedal section 2420 includes a pair of foot pedals 2432, 2436 carried by the retainer plate 2425. The pair of foot pedals 2432, 2436 is adapted to receive the feet of the individual 4000. It should be understood that an operation of the pair of foot pedals 2432, 2436 by the individual 4000 operates the lever arm 2402, thereby rotating the disc shaped member 2100.

Specifically, the pedal section 2420 includes a pair of pulleys 2440, 2442 fitted to the retainer plate 2425. The pair of pulleys 2440, 2442 carries the pair of foot pedals 2432, 2436. The pair of pulleys 2440, 2442 may be provided to facilitate the operation of the pair of foot pedals 2432, 2436. The fitting of the pair of pulleys 2440, 2442 may include aligning the holes 2427, 2429 with the holes (not shown) provided on the pair of foot pedals 2440, 2442 and securing the pair of pulleys 2440, 2442 to the retaining plate 2425 using bolts 2446, 2447 and locking nuts 2448, 2449.

Figure 8:
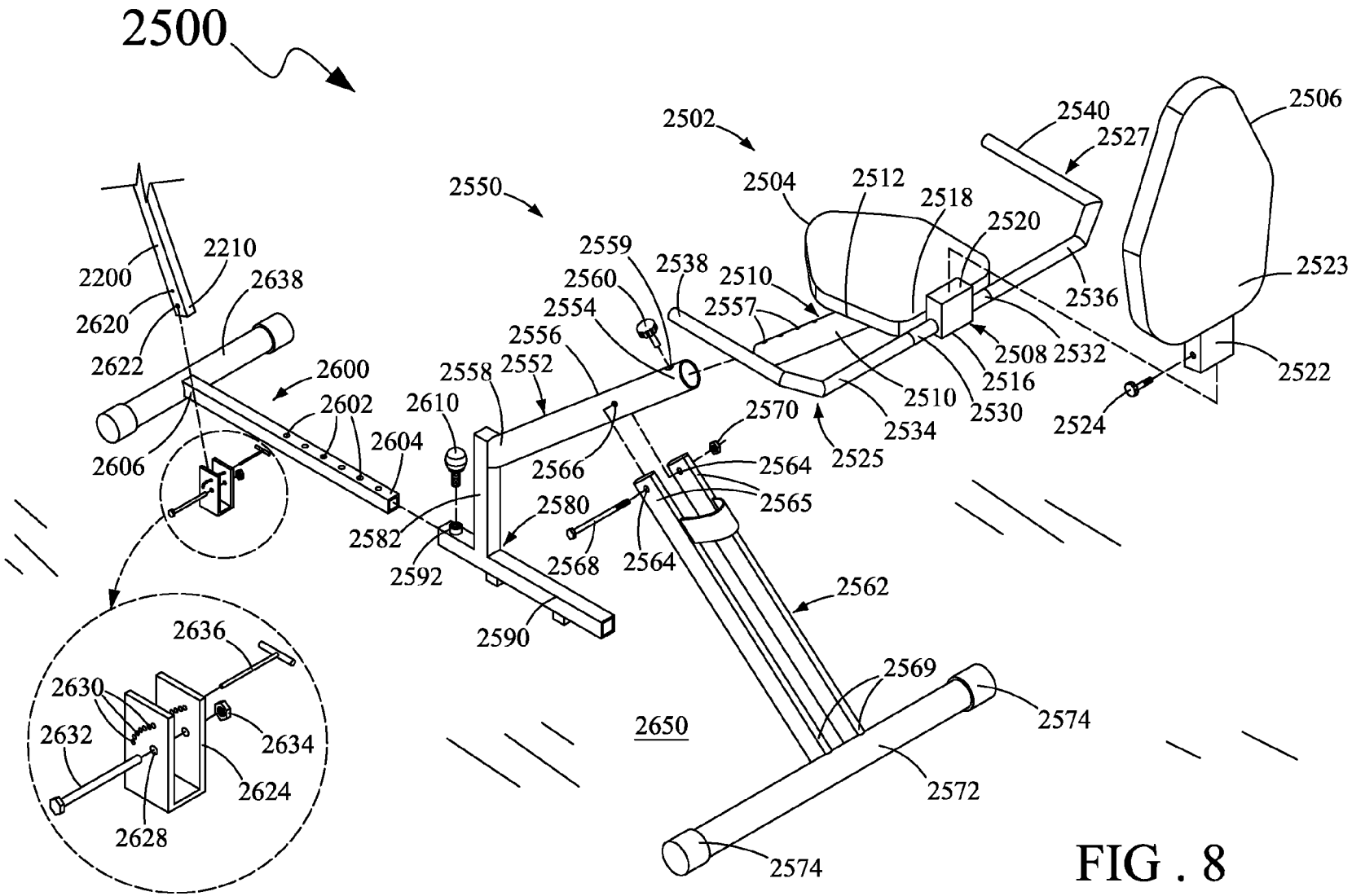

The exercising device 3000 may further include a seating assembly 2500. The seating assembly 2500 may be used for mounting the exercising device 3000, and specifically, the elongated supporting member 2200 thereon. As best shown in FIG. 8, the seating assembly 2500 includes a seating member 2502 adapted to comfortably place the individual 4000 in a position facing the disc shaped member 2100.

The seating member 2502 includes a seat 2504 and a back cushion 2506 connected to the sea 2504 through a connecting member 2508. The seat 2504 may include an attaching portion 2510 extending from a bottom portion 2512. The connecting member 2508 may include a first end portion 2516 extending from and integral to a rear portion 2518 of the seat 2504. Further, the connecting member 2508 may include a second end portion 2520 adapted to telescopically receive an attachment portion 2522 of the back cushion 2506. As shown in FIG. 8, the attachment portion 2522 may extend from a lower end, portion 2523 of the back cushion 2506. Further, the connecting member 2508 may include a knob 2524, similar to knob 2224, for tightly securing the back cushion 2506 to the seat 2504, when the attachment portion 2522 is telescopically received in the seat 2504.

Further, the seating member 2502 includes a pair of hand rail supports 2525, 2527. The hand rail supports 2525, 2527 may be telescopically fitted in extension arms 2530, 2532, respectively, of the connecting member 2508. The hand rail supports 2525, 2527 may include straight arm portions 2534, 2536, respectively, substantially perpendicular to the connecting member 2508, and supporting arm portions 2538, 2540 substantially perpendicular to the straight arm portions 2538, 2540. The hand rail supports 2525, 2527, and specifically, the supporting arm portions 2538, 2540, respectively, may be held by the individual 4000 for support while exercising on the exercising device 3000.

Further, the seating assembly 2500 includes a supporting frame member 2550 adapted to support the seating member 2502 on a ground surface 2650. The supporting frame member 2550 includes a main rod 2552 inclined at an acute angle A with respect to the ground surface 2650. The main rod 2552 includes a first end portion 2554, a central portion 2556, and a second end portion 2558 opposite to the first end portion 2554. The first end portion 2554 of the main rod 2552 is adapted to telescopically receive the attaching portion 2510 of the seat 2504. Specifically, the attaching portion 2510 of the seat includes a plurality of holes 2557. Further, the main rod includes a hole 2559 proximal to the first end portion 2554. To telescopically receive, a hole of the plurality of holes 2557 is aligned to the hole 2559, and a knob 2560, similar to knob 2224, may be operated to tightly securing the telescopically received attaching portion 2510 in the main rod 2552. It should be understood that the telescopic receiving of the attaching portion 2510 in the main rod 2552 facilitates adjustment of height 'H' of the seat 2504 from the ground surface 2650.

Further, the supporting frame member 2550 includes a first stabilizing leg 2562 attached to the central portion 2556 of the main rod 2552. Specifically, the first stabilizing leg 2562 includes a pair of holes 2564 at a first end portion 2565 thereof. To attach the first stabilizing leg 2562 to the central portion 2556, the pair of holes 2564 may be aligned with a hole 2566 on the central portion 2556 of the main rod 2552. After the aligning a locking bolt 2568 may be inserted in the aligned holes 2564, 2566, and a locking nut 2570 may be screwed through the locking bolt 2568.

The first stabilizing leg 2562 is adapted to configure an acute angle B with the main rod 2552. Further, the first stabilizing leg 2562 is adapted to stably support the seating member 2502 on the ground surface 2650. Specifically, the first stabilizing leg 2562 includes a stabilizing rod 2572 extending from and integral to a second end portion 2569 of the first stabilizing leg 2562. The stabilizing rod 2572 is adapted to provide stability to the seating member 2502. Additionally, end portions of the stabilizing rod may include gripping covers 2574 for providing additional stability.

Furthermore, the supporting frame member 2550 includes a L-shaped stabilizing leg 2580. The L-shaped stabilizing leg 2580 includes a vertical leg section 2582 integral to and extending from the second end portion 2558 of the main rod 2552. The L-shaped stabilizing leg 2580 further includes a horizontal leg section 2590 substantially perpendicular to the vertical leg section 2582. The horizontal leg section 2590 is adapted to rest on the ground surface 2650.

Moreover, the supporting frame member 2550 includes a second stabilizing leg 2600 telescopically received in the horizontal leg section 2590 of the L-shaped stabilizing leg 2580. Specifically, the second stabilizing leg 2600 includes a plurality of holes 2602 proximal to a first end portion 2604 thereof. The horizontal leg section 2590 includes a hole 2592. A hole of the plurality of holes 2602 may be aligned with the hole 2592 of the horizontal leg section 2590 of the L-shaped stabilizing leg 2580 and a knob 2610, similar to knob 2224, may be screwed for tightly securing the second stabilizing leg 2600 with the horizontal leg section 2590. It should be understood that the telescopic receiving of the second stabilizing leg 2600 in the horizontal leg section 2590 allows an adjustment of distance 'D' of the disc shaped member 2100 from the seating member 2502.

Further, the second stabilizing leg 2600 is adapted to hinge the elongated supporting member 2200 for supporting the disc shaped member 2100 on the seating assembly 2500. Specifically, the second end portion 2210 of the elongated supporting member 2200 includes a securing hole 2620 and a hinging hole 2622. The second stabilizing leg 2600 includes a bracket 2624 proximal to a second end portion 2606 thereof. The bracket 2624 includes a securing hole 2628 and a plurality of hinging hole 2630. The second end portion 2210 of the elongated supporting member 2200 may be received in the bracket 2624. Further, the securing hole 2620 may be aligned with the securing hole 2628 and bolted using a bolt 2632, and a locking nut 2634. This may tightly secure the elongated supporting member 2200 in the bracket 2624. Further, the hinging hole 2622 may be aligned with one of the plurality of hinging hole 2630, and a locking pin 2636 may be received in the aligned hinging hole 2622 and one of the plurality of hinging hole 2630 to hingably support the elongated supporting member 2200 on the seating assembly 2500. It should be understood that the hinging of the elongated supporting member 2200 in the second stabilizing leg 2600 allows adjustment of inclination angle C of the disc shaped member 2100 with respect to the ground surface 2650.

In addition, the second stabilizing leg 2600 is adapted to stably support the seating member 2502 on the ground surface 2650. For this, the second stabilizing leg 2600 includes a stabilizing rod 2638, similar to the stabilizing rod 2572, attached to the second end portion 2606 thereof.

Figure 9:
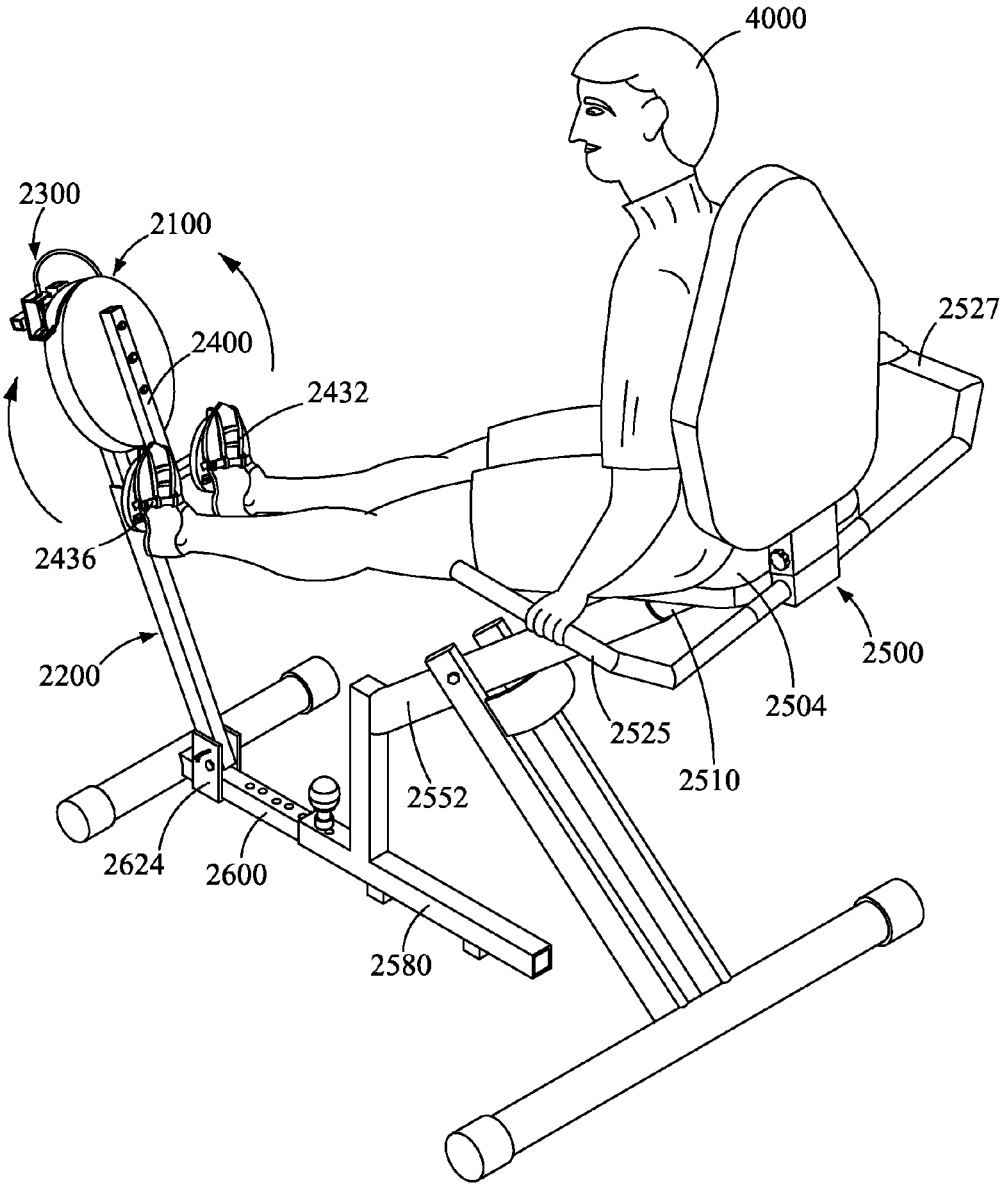
FIG. 9 is a perspective view of the exercising device of FIG. 5 in use.

During utilization of the exercising device 3000, the individual 4000 may first configure the disc shaped member 2100 on the seating assembly 2500. Specifically, the individual 4000 may receive the elongated supporting member 2200 on the bracket 2624 provided on the second stabilizing leg 2600 of the seating assembly 2500, as shown in FIG. 9. The individual 4000 may thereafter adjust the angle of inclination 'C' of the disc shaped member 2100 with respect to the ground surface 2650.

After the adjustment of the angle of inclination 'C', the individual 4000 may adjust the distance 'D' between the disc shaped member 2100 and the seating member 2502. Specifically, the individual 4000 may adjust the extent of telescopic receiving of the second stabilizing leg 2600 in the L-shaped stabilizing leg 2580. Thereafter, the individual 4000 may adjust the height 'H' of the seating member 2502 from the ground surface 2650. Specifically, the individual 4000 may adjust the extent of telescopic receiving of the attaching portion 2510 in the main rod 2552 for adjusting the height 'H' of the seating member 2502. Thereafter, the individual 4000 may comfortably seat on the seat 2504 of the seating assembly 2502 in a position facing the disc shaped member 2100.

After comfortably seating, the individual 4000 may receive his feet in the pair of foot pedals 2432, 2436 and rotate the disc shaped member 2100 in one of a clockwise or an anticlockwise direction. Meanwhile, the individual 4000 may also hold the pair of hand rail supports 2525, 2527 for support. If the individual 4000 intends to vary the resistance to the rotation of the disc shaped member 2100, then the individual 4000 may rotate the knob 2340 provided on the controlling mechanism 2320 to vary the position of the curved brake plate 2302. Such variation in the position of the curved brake plate 2302 may accordingly vary the resistance to the rotation of the disc shaped member 2100. It should be understood that such operation of the disc shaped member 2100 by the individual 4000 against the rotation of the disc shaped member 2100 may exercise the individual.

Further, similar to the elongated supporting member 2200, the seating assembly 2500 may also be made of a lightweight metal, such as aluminum. Alternatively, the seating assembly 2500 may also be composed of a plastic material.

Additionally, the exercising device 1000 or 3000 may include at least one indicia displayed thereon. Specifically, the disc shaped member 100 or 2100 of the exercising device 1000 or 3000 may include at least one indicia (not shown) displayed on at least one of the first surface 102 or 2102 and the second surface 104 or 2104. Further, the exercising device 1000 or 3000 may be manufactured in various colors, weights, and sizes. For example, the disc shaped member 100 or 2100 may be manufactured in various weights. This provided the individual 2000 or 4000 an option of using heavier disc shaped member 100 or 2100 for tougher exercising.

The present disclosure provides an exercising device, such as the exercising device 1000 and the exercising device 3000, which may be utilized by individuals for exercising. The exercising device exercises abdominal muscles as well as the hip flexor muscles. The exercising device also helps the individuals in gaining fit and attractive abs. Further, the exercising device is compact and may be easily installed in any convenient location. Furthermore, the exercising device may be easily uninstalled upon utilization thereof. This makes the exercising device portable. Also the exercising device 1000 may be composed of light weight materials to keep the exercising device lightweight. Also, the exercising device may be manufactured with durable materials, such as stainless steel, plastic, and other such materials, to make the exercising device 1000 durable.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. An exercising device comprising:

a disc shaped member capable of rotating about a point of rotation, the disc shaped member having a first surface, and a second surface opposite to the first surface;

an elongated supporting member facing the second surface of the disc shaped member, the elongated supporting member connected to the point of rotation of the disc shaped member;

a braking mechanism carried by the elongated supporting member, the braking mechanism capable of contacting the disc shaped member to apply a resistance to the rotation of the disc shaped member; and a foot engaging member connected to the first surface of the disc shaped member, the foot engaging member adapted to be operated by feet of an individual, wherein the operation of the foot engaging member rotates the disc shaped member about the point of rotation, and an extendable mounting member adapted to associate the elongated supporting member to a pair of spaced apart members, the extendable mounting member comprising a body member having a first end portion, and a second end portion opposite to the first end portion, a first threaded member threadably attached to the first end portion of the body member, the first threaded member comprising a slotted member at a free end portion thereof, the slotted member adapted to receive a first end portion of the elongated supporting member, and a second threaded member threadably attached to the second end portion of the body member, the second threaded member comprising a slotted member at a free end portion thereof, the slotted member of said second threaded member adapted to receive a second end portion of the elongated supporting member, wherein the receiving of the first end portion of the elongated supporting member and the second end portion of the elongated supporting member mounts the elongated supporting member on the extendable mounting member, and wherein a rotation of the body member extends each of the first threaded member and the second threaded member out of the body member for snugly attaching the first threaded member and the second threaded member to the pair of spaced apart members, wherein the operation of the foot engaging member by the individual against the resistance to the rotation applied by the braking mechanism exercises the individual.

2. An exercising device comprising:

a disc shaped member capable of rotating about a point of rotation, the disc shaped member having a first surface, and a second surface opposite to the first surface;

an elongated supporting member facing the second surface of the disc shaped member, the elongated supporting member connected to the point of rotation of the disc shaped member;

a braking mechanism carried by the elongated supporting member, the braking mechanism capable of contacting the disc shaped member to apply a resistance to the rotation of the disc shaped member; and a foot engaging member connected to the first surface of the disc shaped member, the foot engaging member adapted to be operated by feet of an individual, wherein the operation of the foot engaging member rotates the disc shaped member about the point of rotation, wherein the operation of the foot engaging member by the individual against the resistance to the rotation applied by the braking mechanism exercises the individual, and wherein the braking mechanism comprises a hollow elongated housing carried by a portion of the elongated supporting member, the portion of the elongated supporting member proximal to the point of rotation of the disc shaped member, and an actuation member having a threaded shaft substantially received within the hollow elongated housing, a knob associated with a first end portion of the threaded shaft, the knob capable of rotating for rotating the threaded shaft, and a tab member having a spring associated with a second end portion of the threaded shaft, and a tab associated at a free end portion of the spring, wherein the rotation of the threaded shaft causes the spring to move the tab to and fro for contacting the second surface of the disc shaped member, the contacting of the tab applying the resistance to the rotation of the disc shaped member.

3. An exercising device comprising:

a disc shaped member capable of rotating about a point of rotation, the disc shaped member having a first surface, and a second surface opposite to the first surface;

an elongated supporting member facing the second surface of the disc shaped member, the elongated supporting member having a first support member having an attachment portion, and a second support member telescopically received in the first support member, the attachment portion of the first support member connected to the point of rotation of the disc shaped member, wherein the elongated supporting member is adapted to be detachably associated with a pair of spaced apart members;

a braking mechanism carried by a portion of the elongated supporting member, the portion of the elongated supporting member proximal to the attachment portion of the first support member, the braking mechanism capable of contacting the second surface of the disc shaped member to apply a resistance to the rotation of the disc shaped member; and a foot engaging member extending from the first surface of the disc shaped member, the foot engaging member adapted to be operated by feet of a user, wherein the operation of the foot engaging member rotates the disc shaped member about the point of rotation, wherein the operation of the foot engaging member against the resistance to the rotation applied by the braking mechanism exercises the individual, and an extendable mounting member adapted to associate the elongated supporting member to the pair of spaced apart members, the extendable mounting member comprising a body member having a first end portion, and a second end portion opposite to the first end portion, a first threaded member threadably attached to the first end portion of the body member, the first threaded member comprising a slotted member at a free end portion thereof, the slotted member adapted to receive a first end portion of the elongated supporting member, and a second threaded member threadably attached to the second end portion of the body member, the second threaded member comprising a slotted member at a free end portion thereof, the slotted member of said second threaded member adapted to receive a second end portion of the elongated supporting member, wherein the receiving of the first end portion of the elongated supporting member and the second end portion of the elongated supporting member detachably associates the elongated supporting member on the extendable mounting member, and wherein a rotation of the body member extends each of the first threaded member and the second threaded member out of the body member for snugly attaching the first threaded member and the second threaded member to support the elongated supporting member to the pair of spaced apart members.

4. The exercising device of claim 3, wherein the extendable mounting member further comprises a cushioning cover disposed on an outer surface of the body member.

5. The exercising device of claim 3 wherein the foot engaging member includes a pair of opposed support members structured for receiving feet of an individual therebetween, and wherein the foot engaging member structured to be operated by the feet of the individual when the feet are received between the opposed support members.

6. The exercising device of claim 3, wherein the elongated supporting member comprises a latching mechanism carried by the elongated supporting member, wherein the latching mechanism is capable of engaging with one of at least one hole carried by the second surface of the disc shaped member to preclude the rotation of the disc shaped member in a non-operational state.

7. The exercising device of claim 3, wherein the elongated supporting member comprises at least one level indicator disposed on the attachment portion of the elongated supporting member, the at least one level indicator adapted to indicate alignment of the elongated supporting member with respect to ground.

8. The exercising device of claim 3 wherein the foot engaging member includes a pair of opposed support members spaced apart from the disc shaped member to define a cavity therebetween structured for receiving feet of an individual therein, and wherein the foot engaging member is structured to be operated by feet of a user positioned within the cavity.

9. The exercising device of claim 3, wherein the foot engaging member comprises a shaft attached to the first surface of the disc shaped member, the shaft extending outwardly from the first surface, a support plate attached to a proximal end portion of the shaft, and one or more padded support members extending from the support plate, the one or more padded support members adapted to configure a space for receiving the feet of the individual.

10. The exercising device of claim 3, wherein the braking mechanism comprises a hollow elongated housing having a first end portion and a second end portion, and an actuation member having a threaded shaft substantially received within the hollow elongated housing, a knob associated with a first end portion of the threaded shaft, the knob capable of rotating for rotating the threaded shaft, and a tab member having a spring associated with a second end portion of the threaded shaft, and a tab associated at a free end portion of the spring, wherein the rotation of the threaded shaft causes the spring to move the tab to and fro for contacting the second surface of the disc shaped member, the contacting of the tab applying the resistance to the rotation of the disc shaped member.

11. The exercising device of claim 3, wherein each of the first support member and the second support member comprises a first end portion, and a second end portion opposite to the first end portion, and wherein the second end portion of the first support member is adapted to telescopically receive the second end portion of the second support member, and wherein the telescopic receiving of the second end portion of the second support member in the second end portion of the first support member allows adjustment of length of the elongated supporting member.

* * * * *

UNITED STATES PATENT AND TRADEMARK OFFICE

CERTIFICATE OF CORRECTION

PATENT NO. : 8,529,416 B2
APPLICATION NO. : 12/712633
DATED : September 10, 2013
INVENTOR(S) : Jennings It is certified that error appears in the above-identified patent and that said Letters Patent is hereby corrected as shown below:

On the Title Page, please delete item "(73) Assignee: TK Holdings, Inc.".

Signed and Sealed this
Sixth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,529,416 B2
APPLICATION NO. : 12/712633
DATED : September 10, 2013
INVENTOR(S) : Jennings It is certified that error appears in the above-identified patent and that said Letters Patent is hereby corrected as shown below:

On the Title Page, "item (75)" should read -- item (76) --.

On the Title Page, please delete item "(73) Assignee: TK Holdings, Inc.".

This certificate supersedes the Certificate of Correction issued May 6, 2014.

Signed and Sealed this
Third Day of June, 2014

Michelle K. Lee

Michelle K. Lee
*Deputy Director of the United States Patent and Trademark Office*